US010245627B2

(12) United States Patent
Voges et al.

(10) Patent No.: US 10,245,627 B2
(45) Date of Patent: Apr. 2, 2019

(54) WIDTH AND SPEED CONTROL FOR SHEET METAL DESCALER AND METHODS OF USING SAME

(71) Applicant: The Material Works, Ltd., Red Bud, IL (US)

(72) Inventors: Kevin C. Voges, Red Bud, IL (US); Alan R. Mueth, Red Bud, IL (US); Christopher Craig, Columbia, IL (US)

(73) Assignee: THE MATERIAL WORKS, LTD., Red Bud, IL (US)

( * ) Notice: Subject to any disclaimer, the term of this patent is extended or adjusted under 35 U.S.C. 154(b) by 229 days.

(21) Appl. No.: 15/241,371

(22) Filed: Aug. 19, 2016

(65) Prior Publication Data

US 2018/0050374 A1 Feb. 22, 2018

(51) Int. Cl.
*B21B 45/06* (2006.01)

(52) U.S. Cl.
CPC ..... *B21B 45/06* (2013.01)

(58) Field of Classification Search
CPC ..... B21B 45/04; B21B 45/06; B21B 99/00
See application file for complete search history.

(56) References Cited

U.S. PATENT DOCUMENTS 5,879,465 A 3/1999 McKevitt et al.
6,088,895 A 7/2000 Nelson et al.
7,601,226 B2 10/2009 Voges et al.
8,062,095 B2 11/2011 Voges et al.
8,066,549 B2 11/2011 Voges et al.
8,074,331 B2 12/2011 Voges
8,128,460 B2 3/2012 Voges et al.
8,707,529 B2 4/2014 Voges
9,333,625 B1 5/2016 Voges et al.
2001/0047576 A1 12/2001 Love et al.
2004/0069034 A1 4/2004 Seidel
2009/0002686 A1 1/2009 Voges et al.
2018/0050374 A1 2/2018 Voges et al.

OTHER PUBLICATIONS

International Search Report and Written Opinion for PCT/US2018/018621 dated May 16, 2018.

*Primary Examiner* — Moshe Wilensky
(74) *Attorney, Agent, or Firm* — Thompson Coburn LLP

(57) ABSTRACT

A control for a sheet metal processing line with a descaler includes sensors that adjust the spray blast pattern produced by impellers and the sheet advancement rate during descaling. The control may position a nozzle of the impeller so when a surface condition of the edge of the sheet is more favorable than that of the center of the sheet, the impeller spray concentration moves toward the center, and when a surface condition of the center of the sheet is more favorable than that of a respective edge of the sheet, the impeller spray concentration moves away from the center of the sheet. The control may raise the sheet advancement rate when the surface condition of the center of the sheet is more favorable than a standard, and lower the sheet advancement rate when a surface condition of the center of the sheet is less favorable than a standard.

14 Claims, 8 Drawing Sheets

WIDTH AND SPEED CONTROL FOR SHEET METAL DESCALER AND METHODS OF USING SAME

BACKGROUND AND SUMMARY

The present disclosure is directed to a control system for operating a processing line with a sheet metal descaler. The descaling of the sheet metal may be accomplished via a slurry or a dry abrasive shot blast method. The descaling medium may be propelled against the sheet metal via rotary wheels or impellers. A control with sensors may be used to automatically adjust the spray blast pattern produced by impeller wheels and/or the sheet metal advance rate during descaling of the sheet metal.

DETAILED DESCRIPTION

Figure 1:
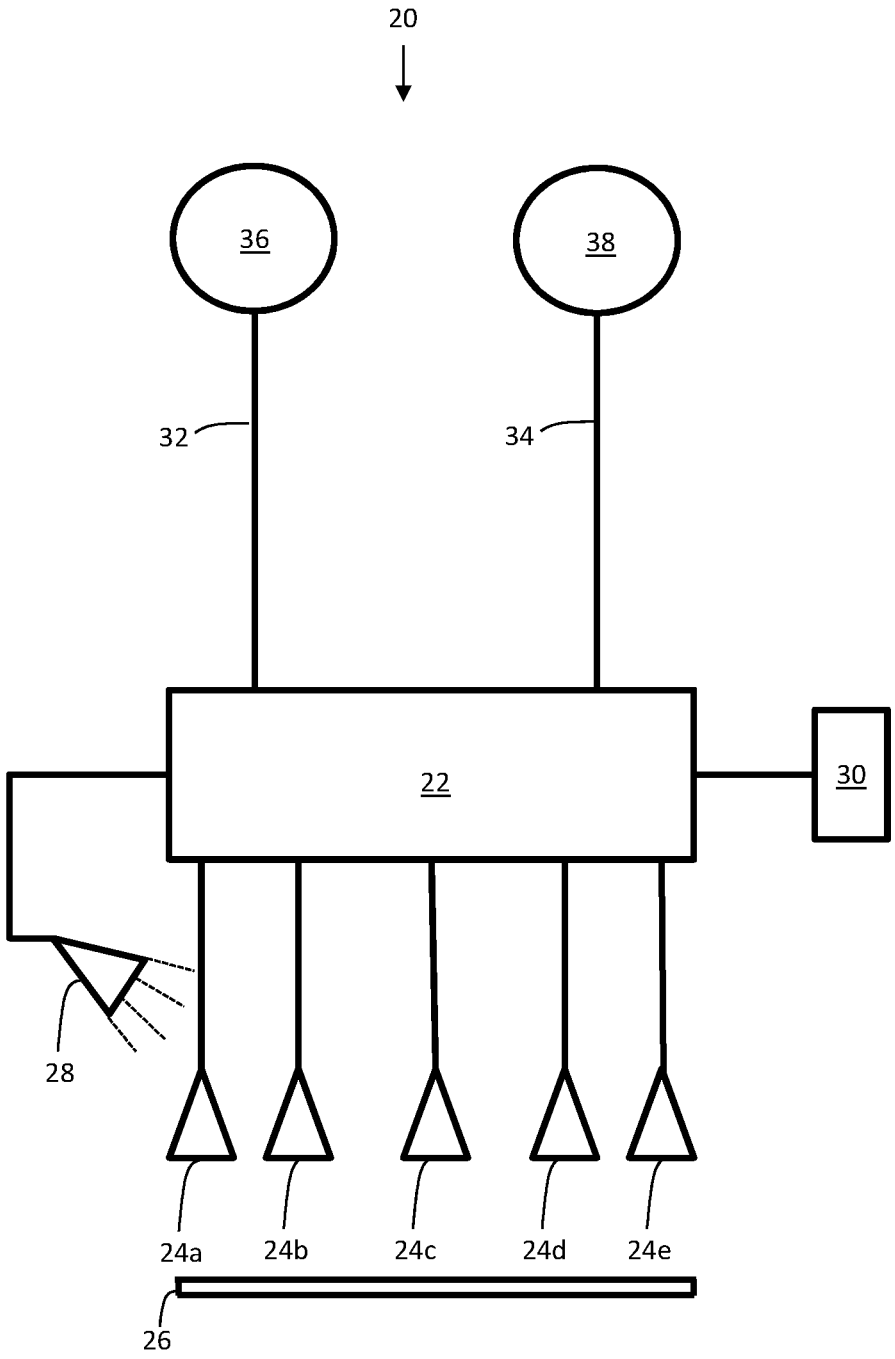
FIG. 1 shows a schematic diagram of a control system and sensor components used in a sheet metal processing line having a descaler.

U.S. Pat. Nos. 7,601,226, 8,062,095, 8,066,549, 8,074,331, 8,128,460, 8,707,529, and 933,625, the disclosures all of which are incorporated by reference herein, describe descaling apparatuses that eliminate scale from the sheet metal. The control system described herein may be used in connection with such sheet metal processing lines. In the following description, the terms "top" and "bottom," "above" and "below," "clockwise" and "counterclockwise," and "upper" and "lower" should not be interpreted as limiting in any way. The terms are used merely for convenience in explaining the relationship of certain elements as they appear in the drawings.

FIG. 1 shows a schematic drawing of a control 20. The control 20 includes a processor 22 that receive input from sensors 24*a*-24*e* that sense the surface condition of sheet metal 26 as it is processed in a descaler. The sensors may be cameras, profilometers, and/or other measuring devices configured to sense the surface condition of sheet metal as it is being processed in the descaler. For illustrative purposes and not in any limiting sense, the sensors may be first and second edge sensors 24*a*,24*e*, intermediate sensors 24*b*,24*d*, and a center sensor 24*c*. The first and second edge sensors 22*a*,22*e* may be configured to sense the condition of the surface of the sheet metal 26 at lateral opposite side edges of the sheet metal. The center sensor 24*c* may be configured to sense the condition of the surface of the sheet metal at a center of the sheet metal. Intermediate sensors 24*b*,24*d* may be also provided to sense the condition of the surface of the sheet metal 26 at positions intermediate of the center and the lateral opposite side edges of the sheet metal. In certain configurations of processing, for instance, descaling narrow width material, the intermediate sensors may be used as edge sensors and the edge sensors 24*a*,24*e* may be disabled from providing input to the control. Each of the sensors may provide input signals to the controller indicative of the condition of the surface of the sheet. A light 28 may also be provided to illuminate the surfaces of the sheet metal to allow the sensors to sense the surface condition of the sheet metal. The signals generated by the sensors may be indicative of surface finish and/or general surface condition. The signals may be indicative of brightness, hue, and saturation associated with an image of the surface of the sheet metal. In one example, the control 20 may comprise a system provided by Keyence Corp. of Itasca, Ill., and in one embodiment, the processor 22 may include a model CV-X172 image sensor and a model CA-DC21E light controller. To provide additional input from other cameras to the image sensor, the image sensor portion of the processor 22 may be provided with a model CV-E 500 camera extension unit. The processor may have one or more user interfaces 30 to allow programming of the processor, operation of the control 20, and remote monitoring of the signals obtained by the sensors 24*a*-24*e*. For instance, the processor may be programmed to allow remote viewing of the images obtained by the sensors via the user interfaces. The processor 22 may be configured to provide output signals 32,34 to programmable logic controls 36,38 associated with descaler or the processing line in which the descaler is employed. The output signals 32,34 may be provided via an ethernet connection or via an RS-232 type connection. For instance, in a system as described in U.S. Pat. No. 8,707,529, the control 20 and processer 22 may be interfaced with the programmable logic control 38 associated with the recoiler and its tensioner to control the rate of advancement of the sheet through the descaling cell. The control 20 and processor 22 may also be interfaced with an actuator 36 associated with a nozzle 40 that directs the scale removing media to each impeller wheel 42 that propels scale removing media against the sheet 26.

Figure 2:
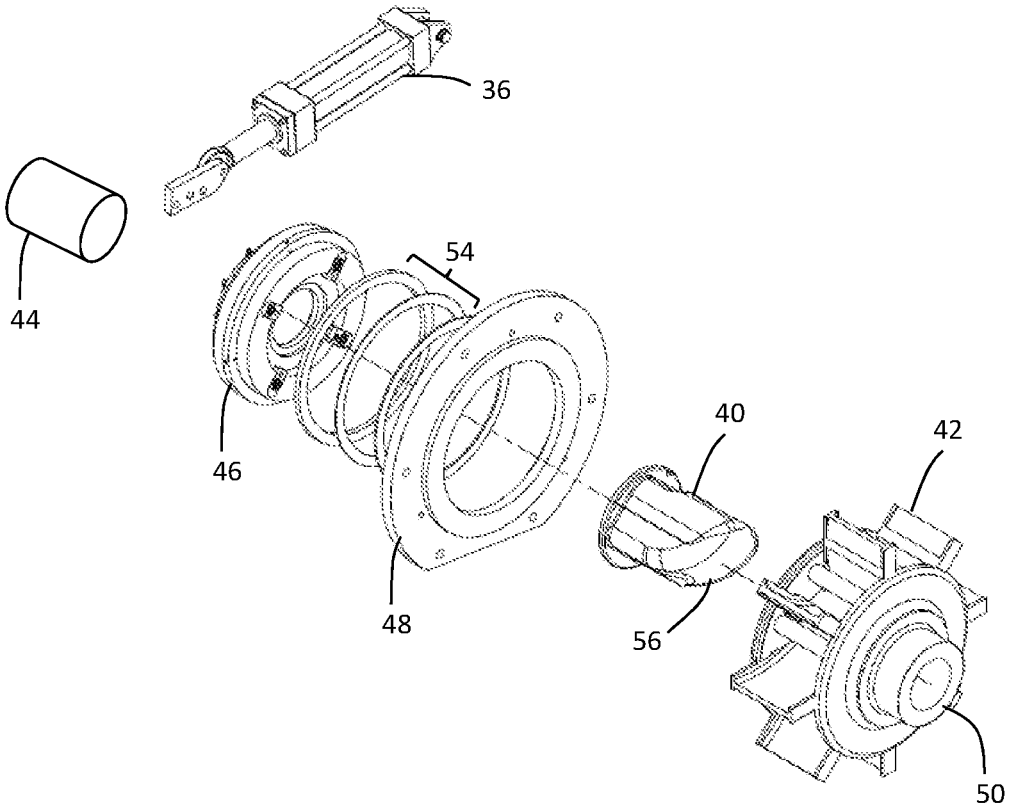
FIG. 2 is an exploded, perspective view of an embodiment of a nozzle actuator, nozzle and impeller wheel.
Figure 3:
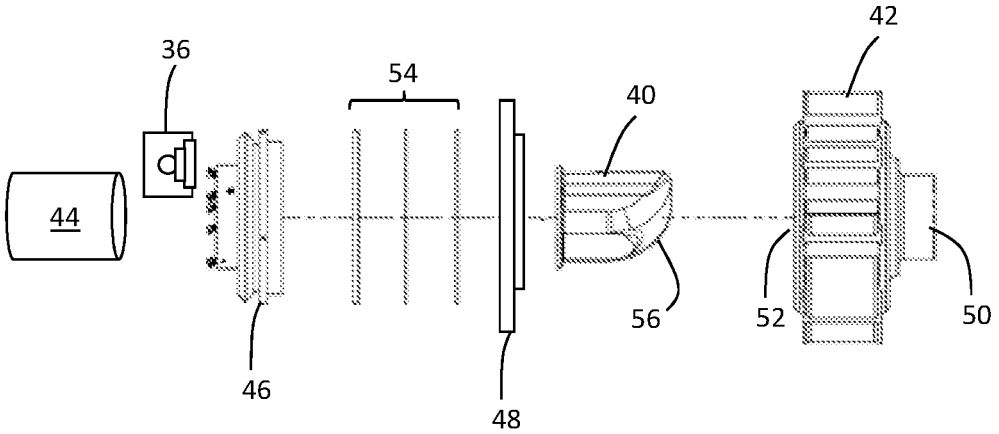
FIG. 3 is an exploded, side elevational view of the components of FIG. 2.

FIGS. 2 and 3 provide additional detail of the nozzle actuator 36, nozzle 40, and impeller wheel 42. A supply of scale removing media may be directed from a supply 44 to each wheel 42 through the nozzle 40 generally to the center of each impeller wheel. The nozzle 40 may be rotatably mounted within hub plates 46,48 and operatively connected to the nozzle actuator 36 such that operation of the actuator may cause rotation of the nozzle 40 within the hub plates. The actuator 36 may be a linear actuator that is operatively pivotally connected to an outer flange of the nozzle 40. Thus, linear motion of the linear actuator may produce rotational motion of the nozzle within the hub plates 46,48. The impeller wheel may be mounted on a shaft 50 driven by an electric motor (not shown). The impeller wheel 42 may have a hollow center that communicates radially with the veins of the impeller wheel. An opening 52 to the hollow center may be provided on the impeller wheel 42 axially opposite the shaft connection 50 to the impeller. The nozzle 40 may extend through the opening 52 and be disposed within the hollow center of the impeller wheel 42 with the hub plates 46,48 and associated disk seals 54 enclosing the opening. The nozzle 40 may have a tapered distal end 56. Actuation of the nozzle actuator 36 may in turn cause rotation of the nozzle 40 within the hub plates 46,48 and orient the tapered end 56 of the nozzle within the hollow center of the impeller wheel 42. Orienting the tapered end 56 of the nozzle at selected positions within the hollow center of the impeller wheel 42 enables changing of the location of the intensity of the spray within the blast pattern area, as will be explained below.

FIGS. 4-11 show schematic views of the impeller wheels 42 associated with the sheet metal descaler and their positioning to achieve blast pattern areas 60,62 with different locations of spray intensity 64,66 relative to the advancing sheet 26 passing through the descaler. While the drawings show the top of the sheet and impellers propelling scale removing medium against the top of the sheet metal, in addition to or in the alternative, an identical arrangement may also be provided for the bottom of the sheet.

The impeller wheels 46 may be arranged on laterally opposite sides (e.g. opposite width edges) of the sheet 26 in a direction transverse to the direction of advancement of the sheet. The first impeller wheel propels scale removing media across the width of the sheet and produces the first blast pattern area 60. The second impeller wheel is positioned offset from the first wheel in the direction of advancement of the sheet so that the scale removing media propelled by the second wheel does not interfere with the scale removing media propelled by the first wheel. The second wheel also propels a scale removing media across the width of the sheet and produces the second blast pattern area 62. The first and second wheels may be rotated in opposite directions so that each wheel propels the scale removing media from the lateral edge of the sheet toward the center of the sheet.

Figure 4:
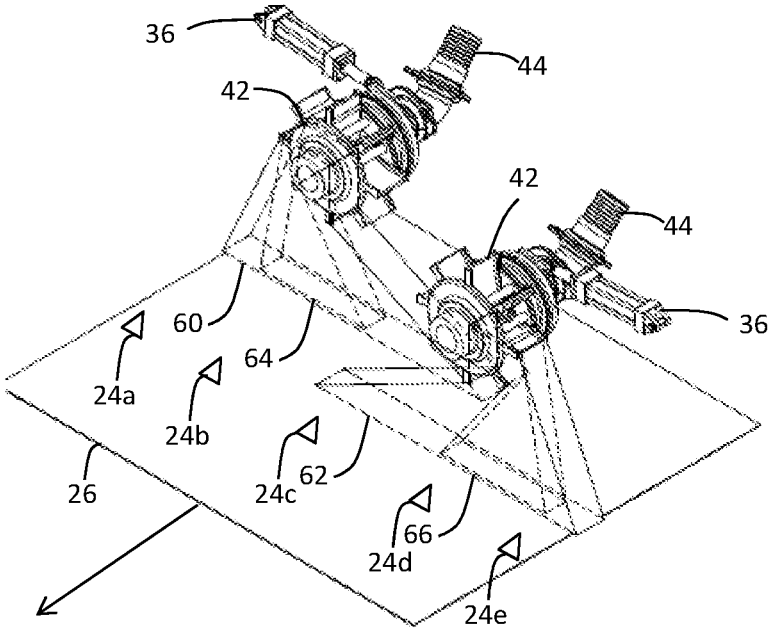
FIG. 4 shows an exemplary blast pattern area for a wide width sheet with an intensity of the spray located generally laterally inward in the blast pattern area toward the center of the sheet.
Figure 5:
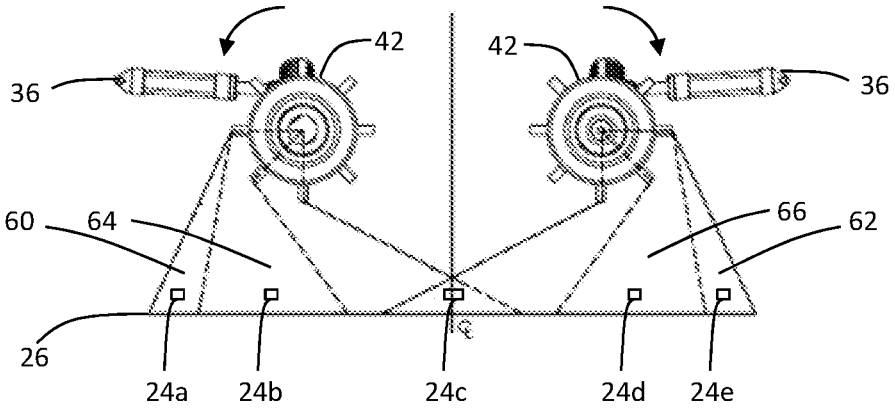
FIG. 5 shows a front view of the blast pattern area of FIG. 4.
Figure 6:
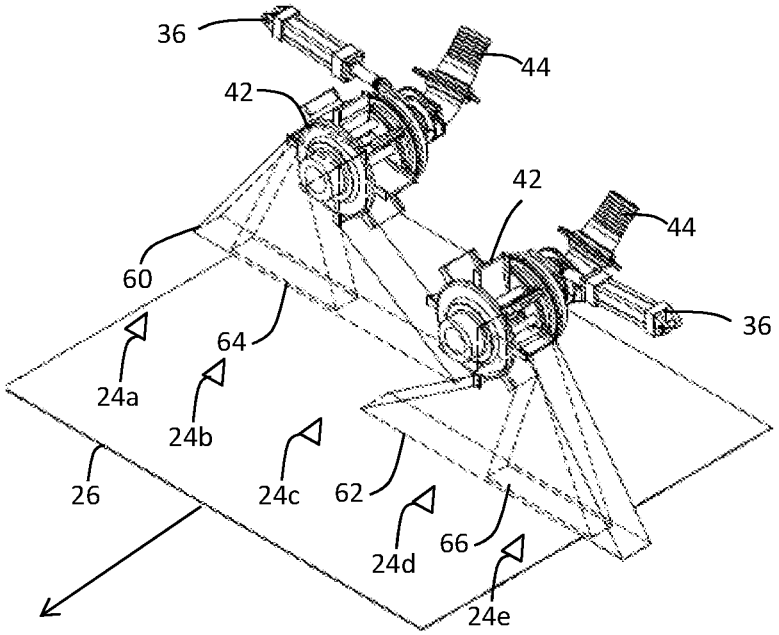
FIG. 6 shows an exemplary blast pattern area for a wide width sheet with an intensity of the spray located generally laterally outward in the blast pattern area toward the lateral edges of the sheet.
Figure 7:
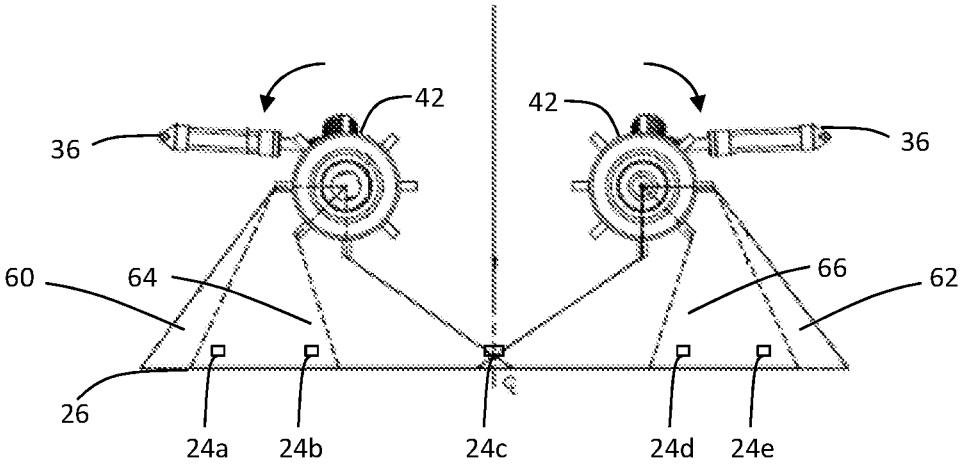
FIG. 7 shows a front view of the blast pattern area of FIG. 6.
Figure 8:
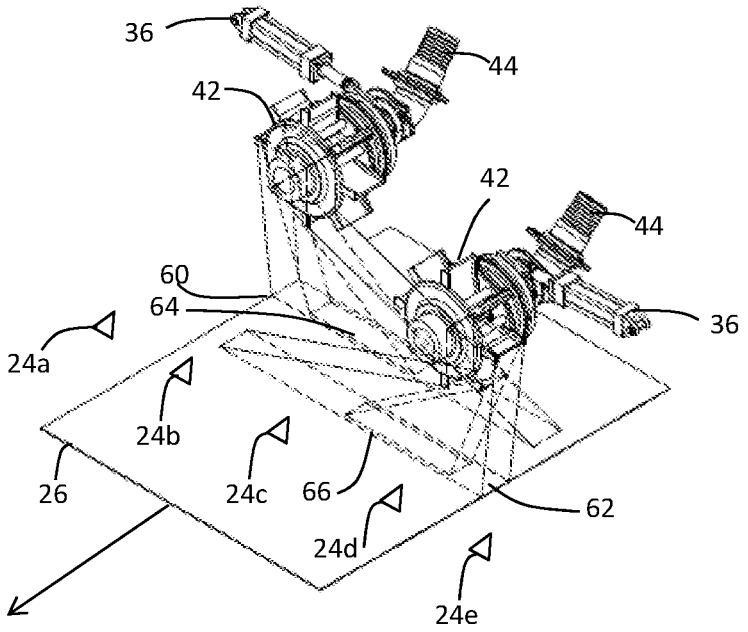
FIG. 8 shows an exemplary blast pattern area for a narrow width sheet with an intensity of the spray located generally laterally inward in the blast pattern area toward the center of the sheet.
Figure 9:
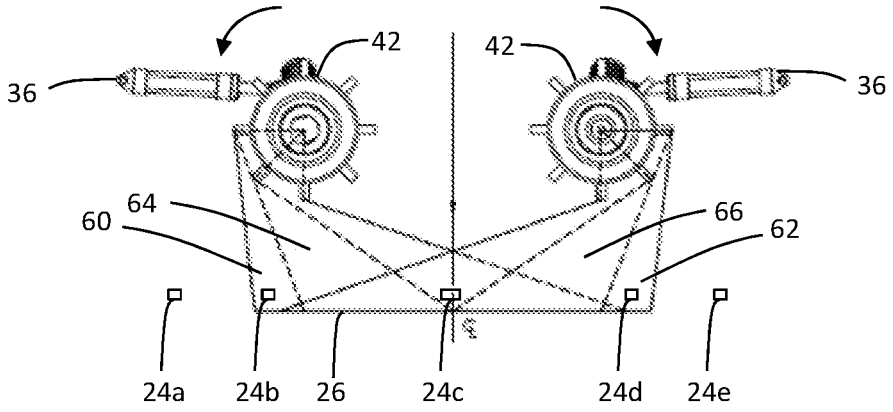
FIG. 9 shows a front view of the blast pattern area of FIG. 8.
Figure 10:
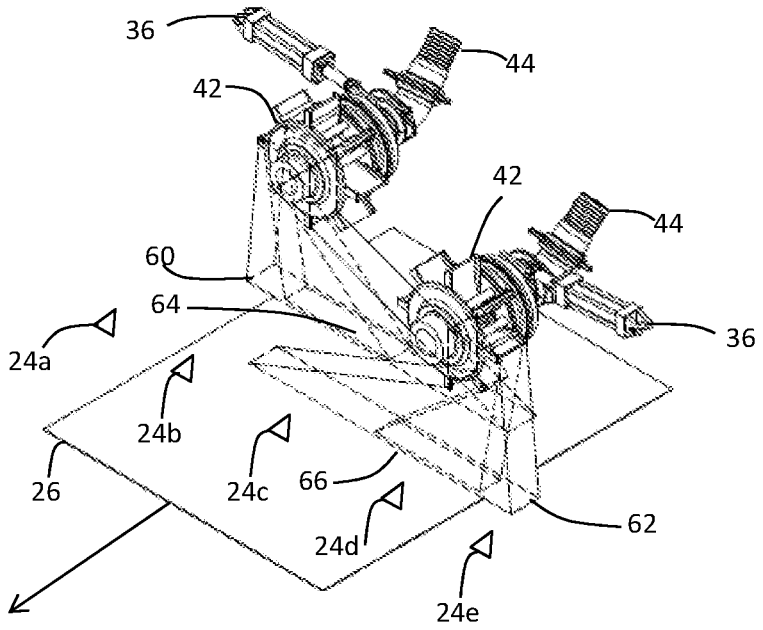
FIG. 10 shows an exemplary blast pattern area for a narrow width sheet with an intensity of the spray located generally laterally outward in the blast pattern area toward the lateral edges of the sheet.
Figure 11:
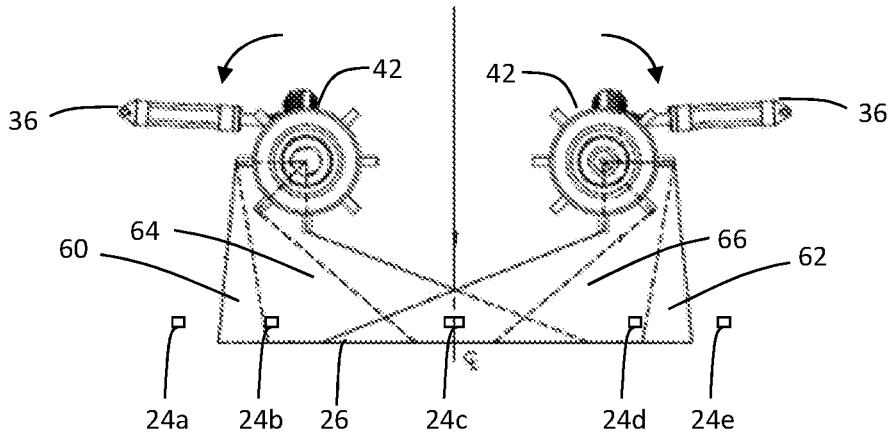
FIG. 11 shows a front view of the blast pattern area of FIG. 10.

As shown in FIGS. 4 and 5, the blast pattern areas 60,62 overlap in the centerline of the sheet. The impeller wheels may rotate such that the scale removing media is propelled against the lateral side edges of sheet and towards the center of the sheet. For instance, as shown in FIG. 5, the first wheel rotates in a clockwise direction so as to propel the scale removing media against an outer width edge of the sheet and then toward the center of the sheet. The second wheel rotates in the counterclockwise direction so as to propel the scale removing media toward the opposite, outer width edge of the sheet and then toward the center of the sheet. FIG. 5 shows a front elevation view of the impellers and the actuator for the nozzle. The same general arrangement is shown in FIG. 6-11.

The edge sensors 24*a*,24*e* and the center sensor 24*c* are provided to detect a surface condition of the sheet 26 after the scale removing medium has been propelled against the surface of the sheet by the first and second wheels 42. As described previously, the center sensor 24*c* may be configured to detect the surface condition of the surface of the sheet in a center of the width of the sheet. The edge sensor 24*a* may be configured to detect the surface condition of the sheet metal adjacent to one side edge. The other edge sensor 24*e* may be configured to detect the surface condition of the sheet adjacent to the opposite side edge. Intermediate sensors may be disposed between the center and edge sensor to provide further input to the control 20 and processor 22. The control may be configured to: (a) receive signals indicative of a surface condition of the sheet as detected by the respective sensors, (b) compare the signals received from the center sensor with each of the signals received from the first and second edge sensors, and (c) transmit positional control signals to each of the nozzle actuators to rotate the respective nozzle relative to the wheel based upon the comparison of the signal of center signal with the signal of at least one of the first and second edge sensors. In wide width material for instance as shown in FIGS. 4-7, the intermediate sensors 24*b*,24*d* may provide signals to the control for further comparison to ensure the surface condition is uniform across the width of the sheet, or the intermediate sensors 24*b*,24*d* may be disabled from providing input to the control. In addition to or in the alternative, for instance, in the case of narrow width material as shown in FIGS. 8-11, the intermediate sensors 24*b*,24*d* may be used as edge sensors. For narrow width material, the intermediate sensors 24*b*,24*d* may be located to coincide with the lateral width edges of narrow width sheets, for instance, as shown in FIGS. 8-11. In such a configuration, the edge sensors 24*a*,24*e* may be disabled from providing input to the control.

Figure 12:
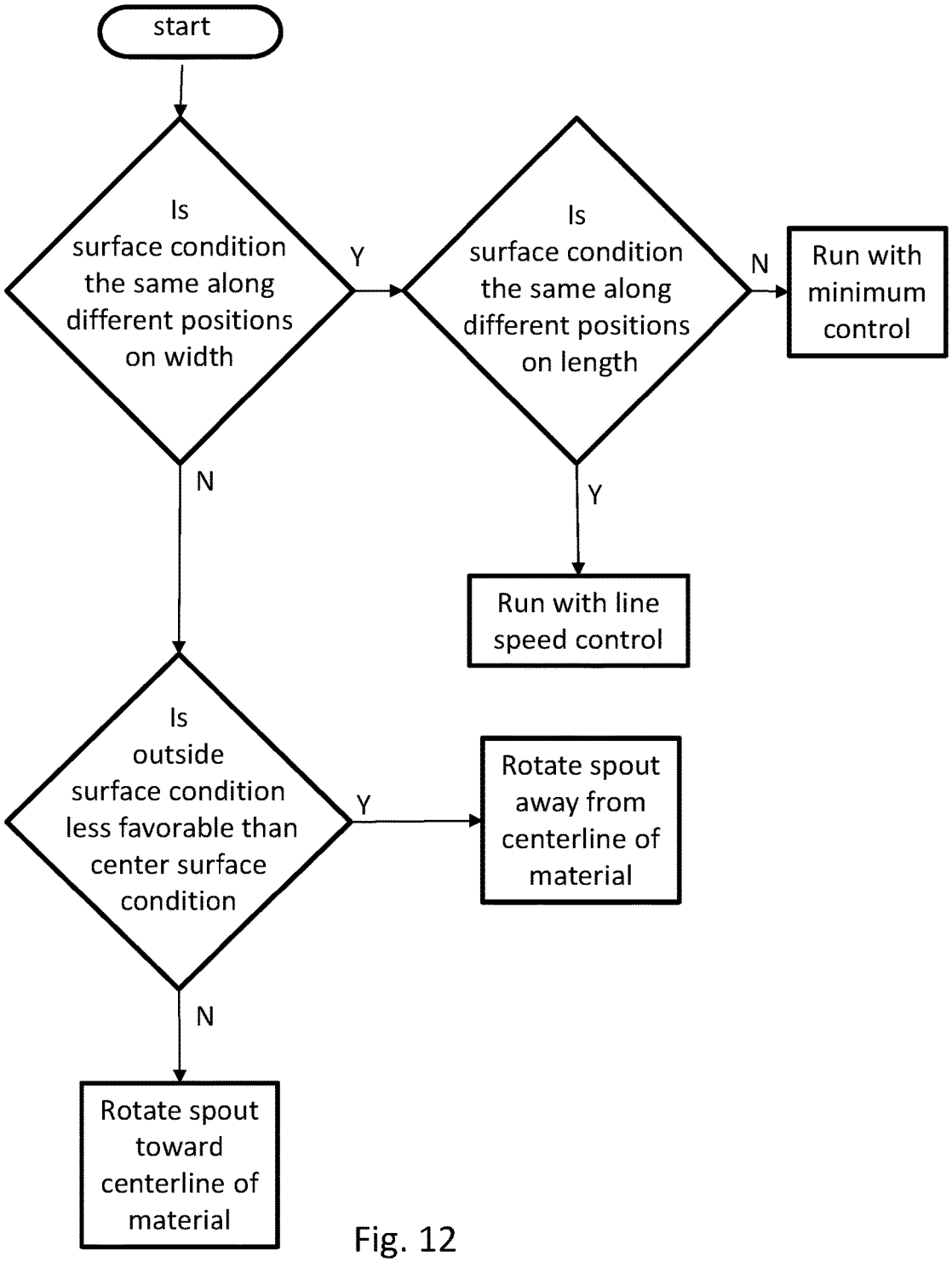
FIG. 12 shows an embodiment of a process flow for a control for a sheet metal processing line having a descaler.

The sensors may be used to provide input to the control for changing the location of the intensity of the spray 64,66 within the blast pattern areas 60,62 and/or changing the rate of advancement of the sheet through the descaler. FIG. 12 shows one embodiment of a process flow for the controller. In one aspect, the sensors may provide input to the control to allow a determination that the surface condition of the processed sheet is consistent across a length. A length standard and length variation threshold may be established. If the comparison of the signal of the center sensor with the length standard is within the length variation threshold (e.g., indicating that the surface condition of the center of the sheet is substantially within specified limits along the length of the sheet ("condition L"), the control may be configured to send signals to the processing line controls (e.g., the PLC associated with the recoiler, or the PLC associated with tensioning rollers in the line) to take no action and maintain the rate of advancement of the sheet. If the comparison of the signal of the center sensor with the length standard indicates that the surface condition of the sheet is more favorable than the length standard (e.g., indicating that the surface condition of the center of the sheet is better than the specified limits), the control may be configured to send signals to the processing line controls to increase the rate of advancement of the sheet until condition L is met. If the comparison of the signal of the center sensor with the length standard indicates that the surface condition of the sheet is less favorable than the length standard (e.g., indicating that the surface condition of the center of the sheet is less than the specified limits), the control may be configured to send signals to the processing line controls to decrease the rate of advancement of the sheet until condition L is met. While the foregoing description uses the signal of the center sensor as a reference, the signals from other sensors may be used, and may be averaged, combined, or otherwise processed in the control to control the rate of advancement of the sheet.

In another aspect, the sensors may provide input to the control to allow a determination that the surface condition of the processed sheet is consistent across the width. A width variation threshold may be established. If the comparison of the signals of the edge sensors with the signal of the center sensor is within the width variation threshold (e.g., indicating that the surface condition of the edges of the sheet is substantially the same as the surface condition of the center of the sheet, or within the allowable width variation threshold), the control may be configured to send signals to the nozzle actuator to take no action and maintain the current position of the nozzle relative to its respective wheels, thereby maintaining the location of the intensity of the spray in the blast pattern area. If the comparison of the edge sensor signals with the center sensor signals shows that the condition of the sheet in the center is more favorable than the condition of the sheet on a lateral side outside of the allowable width variation threshold, the control may generate a signal to the nozzle actuator to reposition the nozzle within the impeller to shift the location of the intensity of the spray of the blast pattern area laterally outward relative to the sheet, for instance, away from the centerline of the sheet. If the comparison of the edge sensor signals with the center sensor signals shows that the condition of the sheet in the center is less favorable than the condition of the sheet on a lateral side outside of the allowable width variation threshold, the control may generate a signal to the nozzle actuator to reposition the nozzle within the impeller to shift the location of the intensity of the spray of the blast pattern area laterally inward relative to the sheet, for instance, toward the centerline of the sheet. The control may be configured to send signals to control to each nozzle actuator and position each nozzle actuator independently of the other nozzle depending upon the signal generated by the respective sensor. In this way, in the event the surface condition of one lateral edge of the sheet varies from the surface condition of the other lateral edge of the sheet, the control may send signals to the respective nozzle actuator to reposition the nozzle for the impeller wheel for the effected side of the sheet, as needed. As mentioned previously, depending upon the width of the sheet, the intermediate sensors may be disable or provide signals that may be averaged, combined, or otherwise processed in the control to control the position of the nozzle actuator and the corresponding location of the intensity of the spray within the blast pattern area.

Figure 13:
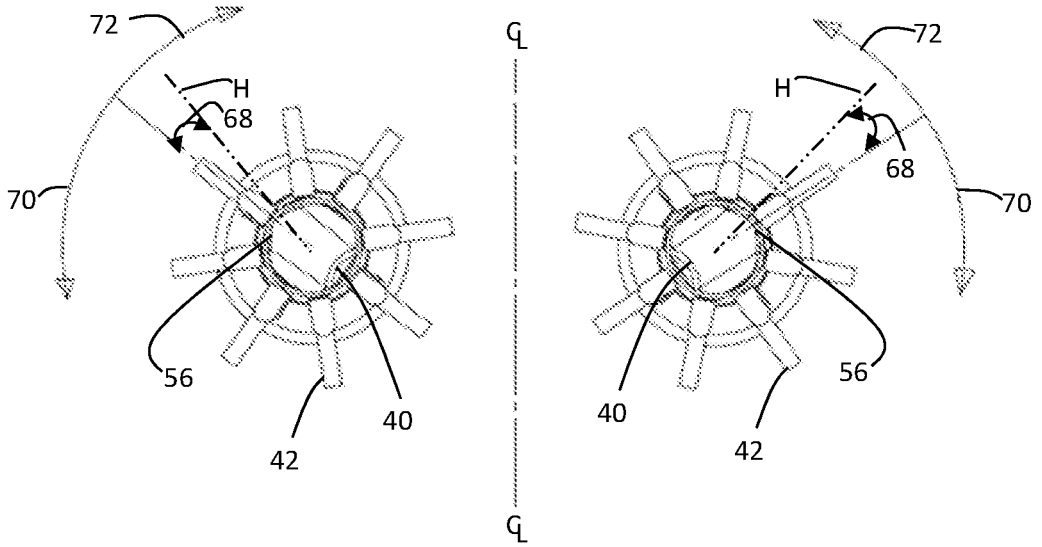
FIG. 13 shows a schematic diagram of a starting nozzle position relative to an impeller wheel for a wide width sheet.
Figure 14:
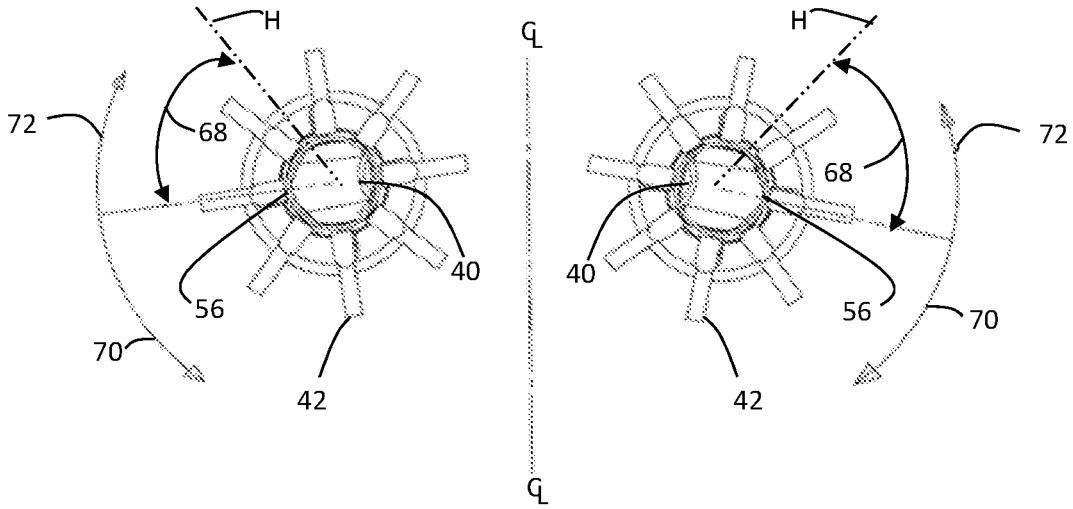
FIG. 14 shows a schematic diagram of a starting nozzle position relative to an impeller wheel for a narrow width sheet.

The control may be configured to send signals to the nozzle actuator 36 to initially adjust the nozzle relative to the impeller wheel 42 to provide a set blast pattern area 60,62 across the width of the sheet based upon the size of the material being processed. For instance, as shown in FIG. 13, if the width of the material is 72 inches, the nozzle position relative to the impeller 42 will may be set at an angle 68 of about five degrees relative to a reference home position H. Once descaling operations begin, the control 20 may begin processing to determine whether the processed sheet has a surface condition consistent along its length and consistent along its width. The control 20 may send signals to the nozzle actuator 36 to rotate the nozzle 40 relative to the impeller wheel in direction 70 laterally inward toward the centerline of the sheet from the 5 degree off home position H, if the comparison of the signals from the edge sensor and the center sensor indicates that the surface condition on the lateral edges of the sheet is more favorable than the surface condition of the center of the sheet. In an opposite fashion, the control 20 may send signals to the nozzle actuator 36 to rotate the nozzle 40 relative to the impeller wheel 42 in direction 72 laterally outward away from the centerline of the sheet from the 5 degree off home position H, if the comparison of the signals from the edge sensor and the center sensor indicates that the surface condition on the lateral edges of the sheet is less favorable than the surface condition of the center of the sheet. In another example, if the sheet metal to be processed has a width of 48 inches, the control 20 may send signals to the nozzle actuator 36 to set the initial nozzle position 40 relative to the impeller at an angle 38 of about 15 degrees relative to a reference home position H. Once descaling operations begin, the control 20 may begin processing to determine whether the processed sheet has a surface condition consistent along its length and consistent along its width. The control 20 may send signals to the nozzle actuator 36 to rotate the nozzle 40 relative to the impeller wheel 42 in direction 70 laterally inward toward the centerline of the sheet from the 15 degree off home position H, if the comparison of the signals from the edge sensor and the center sensor indicates that the surface condition on the lateral edges of the sheet is more favorable than the surface condition of the center of the sheet. In an opposite fashion, the control 20 may send signals to the nozzle actuator 36 to rotate the nozzle relative to the impeller wheel in direction 72 laterally outward away from the centerline of the sheet from the 15 degree off home position H if the comparison of the signals from the edge sensor and the center sensor indicates that the surface condition on the lateral edges of the sheet is less favorable than the surface condition of the center of the sheet.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An apparatus that removes scale from sheet metal, the apparatus comprising:

a descaler that receives lengths of sheet metal and removes scale from at least one surface of the length of sheet metal as the length of sheet metal is moved in a first direction through the descaler;

a supply of a scale removing medium communicating with the descaler and supplying the scale removing medium to the descaler via first and second nozzles, the first and second nozzles each having an actuator configured to rotate the respective nozzle;

first and second wheels on the descaler positioned adjacent the at least one surface of the length of sheet metal passed through the descaler, each of the first and second wheels being configured to receive the scale removing medium from the supply of scale removing medium via the rotatable nozzles, the first wheel having an axis of rotation different from the second wheel, rotation of the first wheel causing the scale removing medium received by the first wheel via the first nozzle to be propelled from the first wheel against the at least one surface across substantially an entire width of the sheet metal and rotation of the second wheel causing the scale removing medium received by the second wheel via the second nozzle to be propelled from the second wheel against the at least one surface across substantially an entire width of the sheet metal, the second wheel being spaced from the first wheel along the first direction a distance sufficient such that the scale removing medium propelled from the second wheel does not substantially interfere with the scale removing medium propelled from the first wheel, the first wheel and the second wheel being positioned adjacent opposite side edges defining the width of the sheet metal with the sheet metal centered between the first wheel and the second wheel; and a control system in communication with the actuators of the first and second nozzles, and in communication with at least three sensors configured to detect a surface condition of the at least one surface of the sheet metal after the scale removing medium has been propelled against the at least one surface of the sheet metal by the first and second wheels, one of the at least three sensors comprising a center sensor configured to detect the surface condition of the at least one surface of the sheet metal in a center of the width of the sheet, two of the at least three sensors comprising edge sensors, one of the edge sensors being configured to detect the surface condition of the at least one surface of the sheet metal adjacent to one side edge defining the width of the sheet metal, the other of the edge sensors being configured to detect the surface condition of the at least one surface of the sheet metal adjacent to the opposite side edge defining the width of the sheet metal, the control being configured to: (a) receive signals indicative of a surface condition of the at least one surface of the sheet metal as detected by the respective sensor, (b) compare the signals received from the center sensor with each of the signals received from the edge sensors, and (c) transmit positional control signals to each of the nozzle actuators to rotate the respective nozzle relative to the wheel based upon the comparison of the signal of center signal with the signal of at least one of the edge sensors; and wherein the control is further configured such that when the comparison of the edge sensor signal to the center sensor signal is indicative that a surface condition of the respective edge of the at least one surface of the sheet metal is more favorable than a surface condition of the center of the at least one surface of the sheet metal, the control is configured to transmit the positional control signal to the nozzle actuator to rotate the nozzle relative to the respective wheel in a manner such that a concentration of the scale removing medium propelled by the respective wheel against the at least one surface across substantially an entire width of the sheet metal moves toward the center of the sheet metal; and wherein the control is further configured such that hen the comparison of the edge sensor signal to the center sensor signal is indicative that a surface condition of the center of the at least one surface of the sheet metal is more favorable than a surface condition of the respective edge of the at least one surface of the sheet metal, the control is configured to transmit the positional control signal to the nozzle actuator to rotate the nozzle relative to the respective wheel in a manner such that a concentration of the scale removing medium propelled by the respective wheel against the at least one surface across substantially an entire width of the sheet metal moves away from the center of the sheet metal.

2. The apparatus of claim 1, wherein the control is configured to transmit the positional control signal to one nozzle actuator independently of the other nozzle.

3. The apparatus of claim 1, wherein the scale removing medium comprises a slurry with a grit.

4. The apparatus of claim 1, wherein the at least three sensors comprises cameras.

5. The apparatus of claim 4, wherein the signals indicative of the surface condition of the at least one surface of the sheet metal comprise signals indicative of at least one of brightness, hue and saturation associated with an image of the at least one surface of the sheet metal produced by the camera.

6. The apparatus of claim 1, wherein the control is configured to compare the signals received from the center sensor with a threshold limit and transmit a speed control signal to control a rate of advancement of the sheet metal through the descaler.

7. The apparatus of claim 6, wherein when the comparison of the center sensor signal to the threshold limit is indicative that a surface condition of the center of the at least one surface of the sheet is more favorable than the threshold limit, the control is configured to transmit the speed control signal indicative of an increase in the rate of advancement of the sheet metal through the descaler.

8. The apparatus of claim 6, wherein when the comparison of the center sensor signal to the threshold limit is indicative that a surface condition of the center of the at least one surface of the sheet is less favorable than the threshold limit, the control is configured to transmit the speed control signal indicative of a decrease in the rate of advancement of the sheet metal through the descaler.

9. An apparatus for removing scale from a length of sheet metal comprising:

a supply of scale removing medium;

a first wheel and second wheel being positionable adjacent to a first surface of the length of sheet metal introduced into the apparatus, the first and second wheels being configured to receive the scale removing medium from the supply via nozzles disposed between the supply and each wheel, each nozzle having an actuator configured to rotate the nozzle relative to the wheel, the first wheel being configured to rotate about a first axis of rotation in a manner such that scale removing medium supplied to the first wheel is propelled by the rotating first wheel against a first area extending across substantially an entire width of the first surface of the length of sheet metal, the second wheel being configured to rotate about a second axis of rotation in a manner such that scale removing medium supplied to the second wheel is propelled by the rotating second wheel against a second area extending across substantially an entire width of the first surface of the length of sheet metal, the second axis of rotation being different from the first axis of rotation, the second wheel being positioned away from the first wheel in a direction of advancement of the sheet metal through the apparatus such that the first area is spaced from the second area along the length of sheet metal, the first wheel and the second wheel being positioned along adjacent opposite side edges defining a width of the sheet metal with the sheet metal centered between the first wheel and the second wheel; and a control system in communication with the actuators of the first and second nozzles, and in communication with a center sensor configured to detect the surface condition of the at least one surface of the sheet metal in a center of the width of the sheet, a first width edge sensor being configured to detect the surface condition of the at least one surface of the sheet metal adjacent to a respective side edge defining the width of the sheet metal associated with the first area, and a second edge sensor being configured to detect the surface condition of the at least one surface of the sheet metal adjacent to a respective side edge defining the width of the sheet metal associated with the second area, each of the sensors configured to detect a surface condition of the at least one surface of the sheet metal as the sheet metal is advanced through the apparatus after the first and second areas, the control being configured to: (a) receive signals indicative of a surface condition of the at least one surface of the sheet metal as detected by the respective sensors, (b) compare the signals received from the center sensor with each of the signals received from the first and second edge sensors, and (c) transmit positional control signals to each of the nozzle actuators to rotate the respective nozzle relative to the wheel based upon the comparison of the signal of center signal with the signal of at least one of the first and second edge sensors; and wherein the control is further configured such that when the comparison of the first edge sensor signal to the center sensor signal is indicative that a surface condition of the respective edge of the at least one surface of the sheet metal is more favorable than a surface condition of the center of the at least one surface of the sheet metal, the control is configured to transmit the positional control signal to the nozzle actuator associated with the first wheel to rotate the nozzle relative to the first wheel in a manner such that the first area moves toward the center of the sheet metal with the scale removing medium being propelled by the first wheel against the sheet metal across substantially an entire width of the sheet metal;

wherein the control is further configured such that when the comparison of the second edge sensor signal to the center sensor signal is indicative that a surface condition of the respective edge of the at least one surface of the sheet metal is more favorable than a surface condition of the center of the at least one surface of the sheet metal, the control is configured to transmit the positional control signal to the nozzle actuator associated with the second wheel to rotate the nozzle relative to the second wheel in a manner such that the second area moves toward the center of the sheet metal with the scale removing medium being propelled by the second wheel against the sheet metal across substantially an entire width of the sheet metal;

wherein the control is further configured such that when the comparison of the first edge sensor signal to the center sensor signal is indicative that a surface condition of the center of the at least one surface of the sheet metal is more favorable than a surface condition of the respective edge of the at least one surface of the sheet metal, the control is configured to transmit the positional control signal to the nozzle actuator associated with the first wheel to rotate the nozzle relative to the first wheel in a manner such that the first area moves away from the center of the sheet metal with the scale removing medium propelled by the first wheel against the sheet metal across substantially an entire width of the sheet metal; and wherein the control is further configured such that when the comparison of the second edge sensor signal to the center sensor signal is indicative that a surface condition of the center of the at least one surface of the sheet metal is more favorable than a surface condition of the respective edge of the at least one surface of the sheet metal, the control is configured to transmit the positional control signal to the nozzle actuator associated with the second wheel to rotate the nozzle relative to the second wheel in a manner such that the second area moves away from the center of the sheet metal with the scale removing medium propelled by the second wheel against the sheet metal across substantially an entire width of the sheet metal.

10. The apparatus of claim 9, wherein the at least three sensors comprises cameras.

11. The apparatus of claim 10, wherein the signals indicative of the surface condition of the at least one surface of the sheet metal comprise signals indicative of at least one of brightness, hue and saturation associated with an image of the at least one surface of the sheet metal produced by the camera.

12. The apparatus of claim 9, wherein the control is configured to compare the signals received from the center sensor with a threshold limit and transmit a speed control signal to control a rate of advancement of the sheet metal through the descaler.

13. The apparatus of claim 12, wherein when the comparison of the center sensor signal to the threshold limit is indicative that a surface condition of the center of the at least one surface of the sheet is more favorable than the threshold limit, the control is configured to transmit the speed control signal indicative of an increase in the rate of advancement of the sheet metal through the descaler.

14. The apparatus of claim 12, wherein when the comparison of the center sensor signal to the threshold limit is indicative that a surface condition of the center of the at least one surface of the sheet is less favorable than the threshold limit, the control is configured to transmit the speed control signal indicative of a decrease in the rate of advancement of the sheet metal through the descaler.

* * * * *